United States Patent [19]

Steiner et al.

[11] Patent Number: 4,531,697

[45] Date of Patent: Jul. 30, 1985

[54] APPARATUS FOR APERTURE BOARDS

[76] Inventors: Gerald E. Steiner; Janice A. Steiner, both of 3155 Meadowbrook Dr., Lancaster, Ohio 43130

[21] Appl. No.: 392,235

[22] Filed: Jun. 25, 1982

[51] Int. Cl.[3] ..... E04G 3/00

[52] U.S. Cl. ..... 248/221.2

[58] Field of Search ..... 248/221.2, 220.3, 221.3, 248/222.2, 225.31, 222.1; 411/508; 24/606, 573, 619, 620

[56] References Cited

U.S. PATENT DOCUMENTS

| | | | |
|---|---|---|---|
| Re. 29,002 | 10/1976 | Govang | 211/59 |
| 2,650,516 | 9/1953 | Poupitch | 411/508 |
| 2,790,616 | 4/1957 | Cardinal | 248/221.2 |
| 2,849,201 | 8/1958 | Schelgunov | 24/619 |
| 2,884,221 | 4/1959 | Messier | 248/361 |
| 2,974,804 | 3/1961 | Maro | 211/60 |
| 3,037,733 | 6/1962 | Roman | 248/221.2 |
| 3,058,706 | 10/1962 | Snell | 248/27.8 |
| 3,089,269 | 5/1963 | McKiernan | 40/143 |
| 3,170,612 | 2/1965 | Blomenschein | 224/45 |
| 3,193,225 | 7/1965 | Terlinde | 248/221.2 |
| 3,193,231 | 7/1965 | Curry | 248/223 |
| 3,195,846 | 7/1965 | Dahlhauser | 248/224 |
| 3,198,469 | 8/1965 | Callanan | 248/223 |
| 3,200,960 | 8/1965 | Banse | 211/59 |
| 3,264,462 | 8/1966 | Haggstrom | 248/220.3 |
| 3,640,497 | 2/1972 | Waki | 248/225 |
| 3,650,502 | 3/1972 | Langhi | 248/225 |
| 3,672,621 | 6/1972 | Bambenek | 248/223 |
| 3,908,949 | 9/1975 | Larson | 248/223 |
| 4,105,179 | 8/1978 | Elliot | 248/221.2 |
| 4,109,795 | 8/1978 | Konigford et al. | 211/57.1 |
| 4,304,382 | 12/1981 | Jelen | 248/220.3 |
| 4,431,355 | 2/1984 | Jünemann | 411/508 |

*Primary Examiner*—William H. Schultz
*Assistant Examiner*—Ramon O. Ramirez
*Attorney, Agent, or Firm*—Emch, Schaffer & Schaub Co.

[57] ABSTRACT

The application discloses a stabilizer for a peg on an aperture board. The stabilizer is positioned in a peg board opening and receives a leg, or the like, of an aperture board accessory such as a holding bracket or peg. The stabilizer includes an elastomeric head section, an elastomeric neck section and a base section. The stabilizer defines an axially extending recess for the reception of a tool during installation and the reception of the bracket leg after installation. A label can be held in place between the aperture board and the bracket or peg by the stabilizer.

1 Claim, 6 Drawing Figures

APPARATUS FOR APERTURE BOARDS

BACKGROUND OF THE INVENTION

Peg board systems are well-known in the art with numerous types of aperture board accessories being offered to the home owner and contractors. Normally aperture board is sized in standard sizes, the most common sizes being aperture board having uniform ⅛ inch diameter openings or ¼ inch diameter openings. Often, the contractor or home owner will install aperture board having ¼ inch diameter openings and then find that the accessories that he desires to use are more readily available and more economical to use in ⅛ inch diameter stock.

In this situation, the user becomes frustrated. When he removes an item from the peg board, because of the looseness of the aperture board accessory, such as a aperture board bracket or peg, the accessory itself sometimes falls to the floor or separates from the aperture board.

Prior attempts to solve this problem have been made. For example, small clips have been utilized which are inserted in the lower aligned opening in the aperture board. However, the clips are normally sized for the same sized opening and same sized accessory, therefore, when the aperture board openings and the accessory stock are of different sizes, the underlying problem is still present.

SUMMARY OF THE INVENTION

The present invention is directed to an apparatus for aperture boards which includes a stabilizer which solves the above-identified problem. Even when the aperture board accessories and the peg board itself are mismatches with respect to the sizes of the aligned openings in the aperture board and the sizes of the accessory stock, by using the present apparatus, the accessory is retained on the aperture board during normal use.

The primary object of the present invention is to provide an improved aperture board system, including a stabilizer which retains a aperture board accessory on the peg board during normal use.

DESCRIPTION OF THE PREFERRED EMBODIMENT

The invention is directed to a stabilizer for hanging aperture board brackets or pegs on a aperture board.

More particularly, the stabilizer is constructed to secure the retaining leg of a bracket or peg to a aperture board having oversized peg board openings. The features of the invention will be more fully understood by referring to the attached drawings in connection with the following description of the invention.

Figure 1:
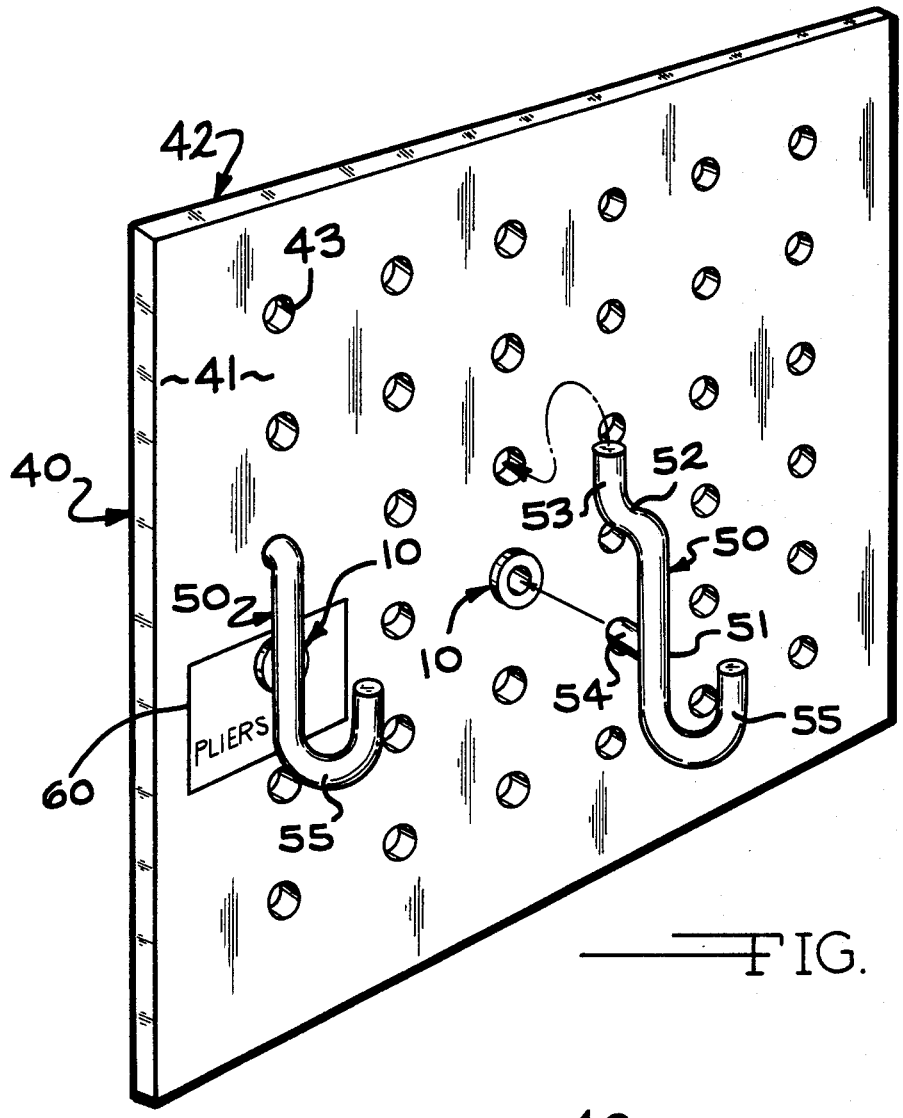
FIG. 1 is a perspective view of a aperture board system including an improved stabilizer, according to the present invention.
Figure 2:
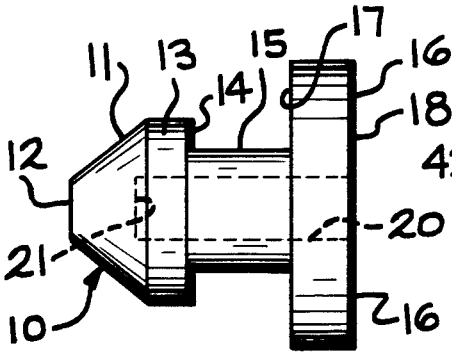
FIG. 2 is an elevation view, taken on an enlarged scale, of the stabilizer shown in FIG. 1.

The stabilizer 10 is to be used with the conventional aperture board 40 having equally spaced rows and columns of cylindrical socket openings 43 distributed substantially over the entire area of the peg board 40. There are many types of aperture board accessories which come in many different configurations. For example, a peg board bracket or peg 50 is typically mounted in a vertical position on the aperture board 40. The aperture board bracket or peg 50 has a straight portion 51, an S-shaped leg 52, a retaining leg 54, and an arm 55. The straight portion 51 is adjacent the S-shaped leg 52. The S-shaped leg 52 extends outwardly beyond the straight portion 51 at a slightly more than 90° angle from the straight portion 51. The extreme end 53 of the S-shaped leg 52 extends from the leg at an angle of slightly more than 90°. The retaining leg 54 extends rearwardly from the lower part of the straight portion 51. The retaining leg 54 is substantially perpendicular to the straight portion 51. The retaining leg 54 and the S-shaped leg 52 are so spaced that they register with the openings 43 in the peg board 40 to permit insertion of each leg into the aperture board 40. The arm 55 extends frontwardly from the lower part of the straight portion 51. The arm 55 can have many configurations, for example the hook-shapes, as shown in FIG. 1.

The bracket or peg 50 is placed on the aperture board 40 by inserting the extreme end 53 of the S-shaped leg 52 into an opening 43. The bracket or peg 50 is pivoted about an axis through the S-shaped portion of the leg 52, causing the extreme end 53 to engage the rear surface 42 of the aperture board 40, and causing the retaining leg 54 to be inserted through an adjacent opening 43. Various items and accessories can then be hung on the aperture board bracket or peg 50 and easily displayed on the peg board surface.

It has been found that where the aperture board openings 43 have one-fourth inch diameters and the brackets or pegs 50 have one-eighth inch diameters, problems result. It is desirable for the bracket or peg 50 to remain firmly in position on the aperture board 40 when removing an item hung on the bracket or peg. Otherwise the brackets or pegs are often also removed. In order to secure the bracket or peg 50 on the aperture board 40, the applicants have developed a stabilizer 10 that is formed into a shape that will easily fit into the aperture board opening 43.

The stabilizer 10 is shown as being substantially cylindrical but it should be understood that other shapes can be used. The stabilizer 10 is made of a substantially elastomeric material such as a Neoprene material. The stabilizer 10 generally includes a head section 11, a neck section 15, a base section 16, and a recess 20. The head section 11, has a frustoconical extremity 12 and terminates in a shoulder 13. The shoulder 13 is adjacent the neck section 15 and extends radially from the neck section 15. The shoulder 13 is greater in diameter than the diameter of the neck section 15. The shoulder 13 is substantially perpendicular to the neck section 15. The neck section 15 is cylindrical in shape and its diameter is complementary with the diameter of a aperture board opening 43. In the preferred embodiment, the length of the neck section 15 is complementary with the thickness of the aperture board 40 such that the stabilizer 10 fits snugly into the opening 43. The base section 16 is adjacent the neck section 15. The base section 16 is greater in diameter than the diameter of the neck section 15 and extends radially from the neck section 15. The base section 16 is substantially perpendicular to the neck section 15. The stabilizer 10 defines an axially extending recess 20. The recess extends through the base section 16 and the neck section 15. The distal end 21 of the recess 20 terminates in the head section 11. The diameter of the recess 20 is slightly smaller than the diameter of a aperture board bracket leg 54.

In order to insert the stabilizer 10 into the aperture board opening 43, the applicants have developed a tool 30 that facilitates exerting the necessary force. The tool 30 is generally made of a substantially rigid material, such as a hard plastic or metal. The tool 30 generally includes a shaft 31 and a handle 32. The shaft 31 is generally greater in length than the length of the recess 20 in the stabilizer 10. The diameter of the shaft 31 can be substantially the same as, or slightly smaller than, the diameter of the recess 20, thus allowing easy insertion and removal of the tool 30 from the recess 20. The handle 32 is adjacent the shaft 31 and is substantially centered on the shaft 31, forming a T-shape, and is substantially perpendicular to the shaft 31.

Figure 3:
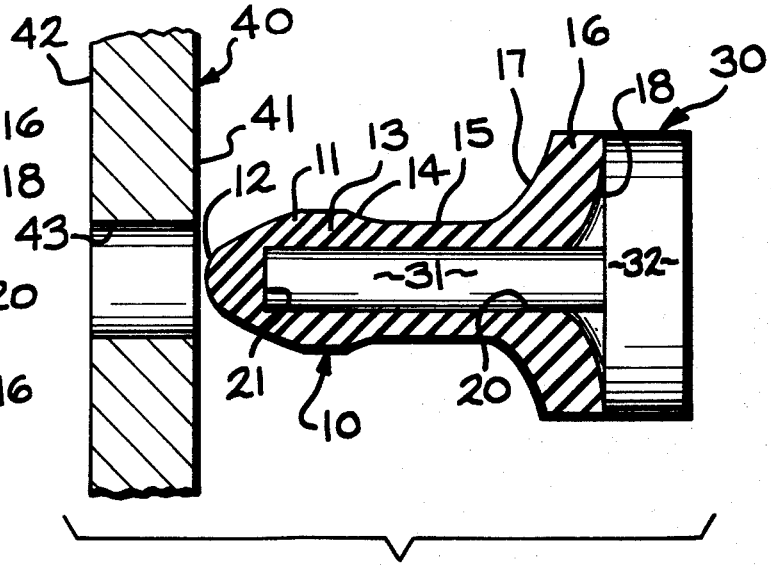
FIG. 3 is an exploded view, partially in cross-section of a stabilizer being inserted in a aperture board opening using a stabilizer tool, according to the present invention.
Figure 4:
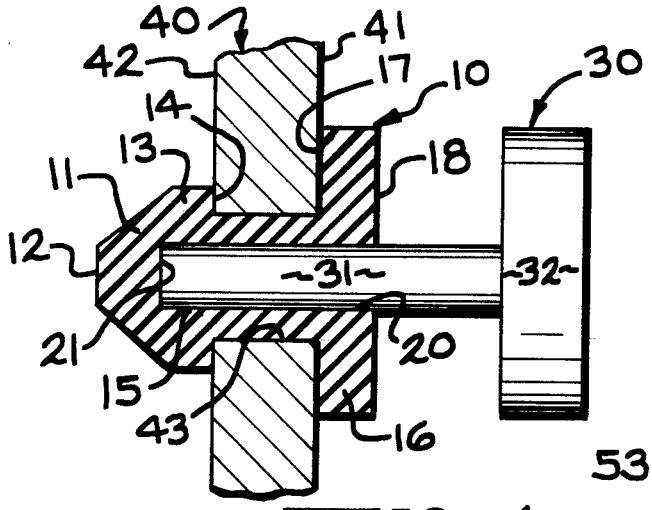
FIG. 4 is a view similar to FIG. 3 showing the stabilizer after installation but prior to the removal of the stabilizer tool.

Referring to FIGS. 3–4, in order to insert a stabilizer 10 into the aperture board opening 43, the tool 30 is positioned in the stabilizer 10, and both the tool 30 and stabilizer 10 are positioned in the opening 43. The shaft 31 of the tool 30 is inserted into the recess 20 of the stabilizer 10 until it contacts the distal end 21 of the recess 20.

The stabilizer 10 is stretched by forcing the base section 16 against the handle 32. This can be conveniently accomplished by holding the stabilizer 10, with the inserted tool 30, at the neck section 15 between the index and middle fingers and pressing the back surface 18 of the base section 16 towards the handle 32. The thumb exerts an opposing force against the bottom surface of the handle 32.

The head section 11, neck section 15, and base section 16 are longitudinally stretched such that the entire stabilizer 10 is deformed and the diameters of the corresponding parts are decreased as shown in FIG. 3.

The stabilizer 10 and tool 30 are moved or inserted into the opening 43. The head section 11 and the first shoulder 13, by being longitudinally stretched, are narrow enough to be inserted through the opening 43. The head section 11 and the first shoulder 13 protrude from the rear surface 42 of the aperture board 40. The force of the base section 16 against the handle 32 is relaxed such that the head section 11 is no longer deformed and the bottom surface 14 of the shoulder 13 snugly engages the back surface 42 of the peg board 40. The head section 11 and the first shoulder 13, in their relaxed condition, are wide enough to anchor the stabilizer 10 to the aperture board 40. The neck section 15, when in a relaxed condition, has a diameter complementary with the diameter of the aperture board opening 43. The force of the base section 16 against the handle 32 is released such that the second shoulder 17 and the base section 16 snugly engage the front surface 41 of the aperture board 40. The tool 30 is slideably withdrawn from the recess 20 by advancing the handle 32 in a direction away from the stabilizer 10 leaving the stabilizer 10 snugly in place in the aperture board opening 43. Because shaft 31 is substantially the same diameter as, or slightly smaller than, the diameter of the recess 20, this helps to prevent the stabilizer 10 from being dislodged during the removal of the tool 30.

Figure 5:
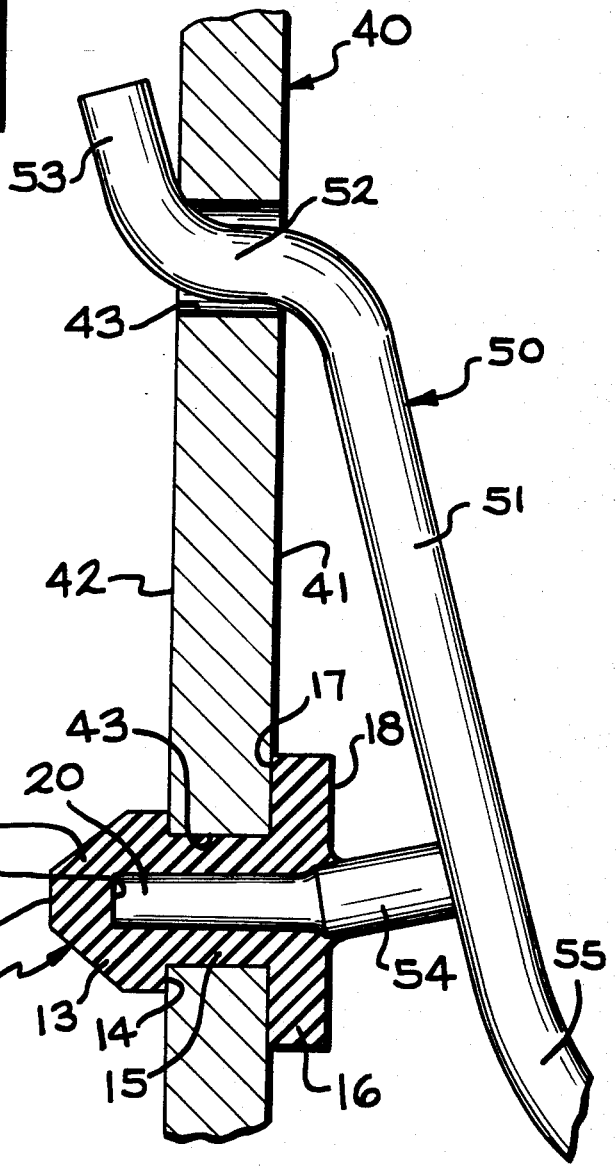
FIG. 5 is a view, partially in cross-section of a retaining leg of a aperture board bracket or peg being inserted in the axially extending recess of the stabilizer.
Figure 6:
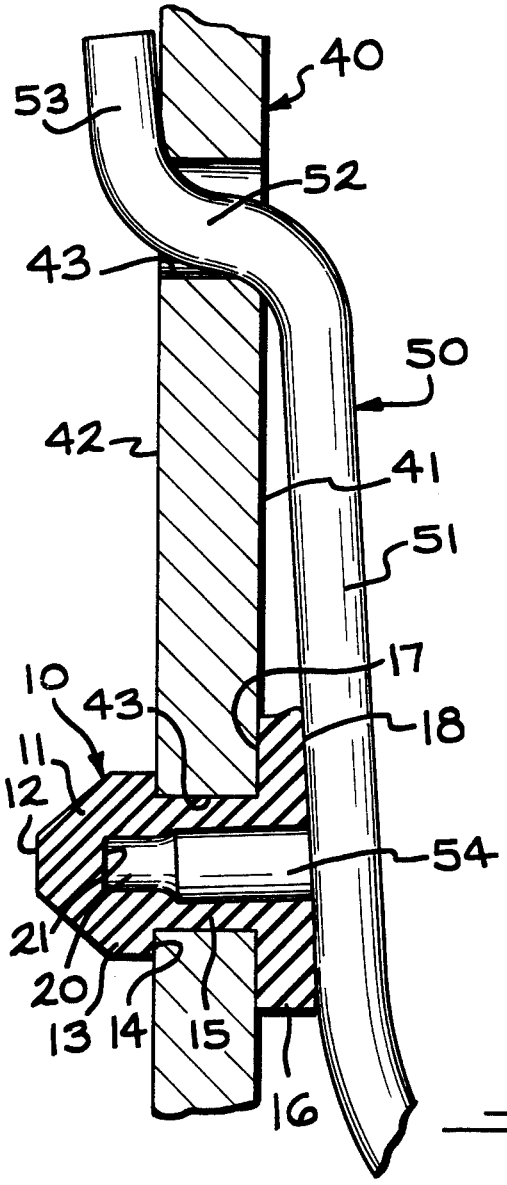
FIG. 6 is a view similar to FIG. 5 taken after insertion of the bracket or peg retaining leg in the stabilizer.

The aperture board bracket or peg 50 is placed on the peg board 40 by inserting the S-shaped leg 52 into an opening 43 adjacent the opening containing the stabilizer 10 as shown in FIG. 5. The bracket or peg 50 is pivoted about an axis through the S-shaped portion 52 causing the extreme end 53 to engage the rear surface 42 of the aperture board 40 and causing the retaining leg 54 to come into contact with the front surface 18 of the base section 16. Since the diameter of the retaining leg 54 is sufficiently greater than the diameter of the recess 20, a small amount of force is needed to insert the retaining leg 54 into the recess 20. The elastomeric material of the stabilizer 10 is in a compressed condition. Accordingly, the retaining leg 54 is held firmly in place in the recess 20. This snug engagement prevents the loosening of the bracket leg 54 from the recess 20, when an item is removed from the aperture board 40 during normal use.

Brackets or pegs with varying size retaining legs can be held firmly in place by use of such a stabilizer. The diameter of the recess 20 can be varied, if necessary, to accommodate the various size retaining legs. The length of the recess can also be extended to accommodate longer retaining legs. The length and diameter of the neck of the stabilizer can also be varied, to adapt to a aperture board of any material or structure.

A label 60 can be inserted between the front surface 41 of the aperture board 40 and the back surface 17 of the base section 16 to identify the item hung on the bracket or peg and/or the proper place for hanging or displaying the item. The label 60 is held in place on the aperture board 40 by the stabilizer 10.

The above-detailed description of the invention is given only for the sake of explanation. Various modifications and substitutions other than those cited, can be made without departing from the scope of the invention as defined in the following claims.

What we claim is:

1. A stabilizer for use with an aperture board system having a plurality of spaced openings and an aperture board bracket or peg having a retaining leg for insertion in one of such spaced openings comprising, in combination:

an aperture board having a plurality of spaced openings;

an elastomeric head section for insertion in one of such spaced openings, said head section including a frustoconical portion having an outer extremity smaller than the diameter of such spaced opening for guiding said stabilizer in place within such spaced opening;

an elastomeric neck section integrally connected to said head section, said neck section, when in a relaxed condition having a diameter complementary with the diameter of such spaced opening, said head section defining a first shoulder adjacent to said neck section and extending outwardly therefrom, said first shoulder having an outer periphery greater than the circumference of such opening to anchor said stabilizer in said opening, said first shoulder being radially deflectable for insertion through such opening;

a base section integrally connected to said neck section, said base section defining a second shoulder adjacent said neck section and opposed to said first shoulder, said second shoulder having an outer periphery greater than the circumference of such spaced opening; and an axial recess extending from said base section through said neck section into said head section for receiving a tool during installation and said bracket or peg retaining leg after installation.

* * * * *